US007786966B2

(12) United States Patent
Nakanishi et al.

(10) Patent No.: US 7,786,966 B2
(45) Date of Patent: Aug. 31, 2010

(54) METHOD FOR DRIVING LIQUID CRYSTAL PANEL, AND LIQUID CRYSTAL DISPLAY DEVICE

(75) Inventors: Kunifumi Nakanishi, Tokyo (JP); Tomoya Teragaki, Kumamoto (JP)

(73) Assignee: Mitsubishi Electric Corporation, Tokyo (JP)

( * ) Notice: Subject to any disclaimer, the term of this patent is extended or adjusted under 35 U.S.C. 154(b) by 992 days.

(21) Appl. No.: 11/456,419

(22) Filed: Jul. 10, 2006

(65) Prior Publication Data

US 2007/0008274 A1 Jan. 11, 2007

(30) Foreign Application Priority Data

Jul. 11, 2005 (JP) ..... 2005-201659

(51) Int. Cl.
*G09G 3/36* (2006.01)

(52) U.S. Cl. ..... 345/89; 345/87

(58) Field of Classification Search ..... 345/87–111
See application file for complete search history.

(56) References Cited

U.S. PATENT DOCUMENTS 6,496,170 B1 * 12/2002 Yoshida et al. ..... 345/87
6,697,036 B2 * 2/2004 Yamada et al. ..... 345/87
2005/0184946 A1 * 8/2005 Pyoun et al. ..... 345/94

FOREIGN PATENT DOCUMENTS

| | | |
|---|---|---|
| JP | 9-211427 | 8/1997 |
| JP | 10-186326 | 7/1998 |
| JP | 2002-182624 | 6/2002 |
| JP | 2002-351426 | 12/2002 |

* cited by examiner

*Primary Examiner*—Srilakshmi K Kumar
(74) *Attorney, Agent, or Firm*—Oblon, Spivak, McClelland, Maier & Neustadt, L.L.P.

(57) ABSTRACT

A method for driving a liquid crystal panel that includes horizontal scan wires, data wires, pixel electrodes surrounded by the horizontal scan wires and the data wires; and switching elements connected to the pixel electrodes, wherein the switching elements are controlled by a gate selection signal and during a on-time period, the switching elements is turned on, and an image data signal output from the data wires is supplied to the pixel electrodes by the switching elements. The method includes: detecting a peripheral temperature of the liquid crystal panel; and controlling the gate selection signal so that when the detected temperature is within a normal temperature range, the on-time period is set to a first gate selection period, and that when the detected temperature is within a low temperature range, the on-time period is set to a second gate selection period longer than the first gate selection period.

7 Claims, 6 Drawing Sheets

METHOD FOR DRIVING LIQUID CRYSTAL PANEL, AND LIQUID CRYSTAL DISPLAY DEVICE

BACKGROUND OF THE INVENTION

1. Field of the Invention

The present invention relates to a method for driving a liquid crystal panel, and a liquid crystal display device, and particularly to a method for driving an active matrix type liquid crystal panel that can surely display an image irrespective of peripheral temperature of the liquid crystal panel, and a liquid crystal display device.

2. Description of the Related Art

Recently, liquid crystal display devices have been applied for various kinds of applications under various environments. For example, with respect to peripheral temperature, it is required that these devices are excellently operated at from a high-temperature to a low-temperature.

Furthermore, TFT (Thin Film Transistor), TFD (Thin Film Diode), etc. are known as switching elements for the active matrix type liquid crystal display devices. Particularly, from the viewpoint of the image quality, TFT has been recently mainly used. In general, the charging performance of TFT has temperature dependence, and as the temperature is lowered, the charging performance is reduced. Therefore, in a line inverting driving method broadly used as a method of AC-driving each frame of the liquid crystal cell or a dot inversion driving method, charging to pixels is insufficient under such a environment that the peripheral temperature is relatively low, and no desired voltage is applied to liquid crystal (in the following description, the peripheral temperature means the temperature of the liquid crystal panel or temperature near the liquid crystal panel). As a result, in a normally white mode using general TN (Twist Nematic) type liquid crystal, the shift of the voltage-brightness characteristic to a high brightness side, increase of black brightness, reduction in contrast, etc. occur, and thus there is a problem that the image quality is degraded. Likewise, a normally black mode has problems such as the shift of the voltage-brightness characteristic to a low brightness side, disturbance of uniformity in brightness under high-brightness state, reduction of contrast due to reduction of white brightness, etc.

In order to prevent degradation of the image quality under the low-temperature condition, there is known a method for driving a liquid crystal panel in which every two scan lines are successively selected from plural scan lines under the low-temperature condition, and before a liquid crystal cell is charged at the original gradation potential corresponding to an image data signal, the liquid crystal cell concerned is preliminarily charged at the gradation potential corresponding to a liquid crystal cell which is preceding to the liquid crystal cell concerned by one or more lines and has the same color arrangement as the liquid crystal cell concerned (see JP-A-Hei. 10-186326).

Furthermore, in order to avoid an erroneous display caused by delay of display under the low-temperature condition, there has been proposed a method of connecting a display RAM to an LCD controller, making a display on the basis of image data of one frame written in RAM, and renewing image data written in RAM at the time interval corresponding to the peripheral temperature (see JP-A-Hei. 9-211427).

SUMMARY OF THE INVENTION

According to the liquid crystal panel driving method based on the preliminary charging, with respect to the image data of some pixel, the image data of another pixel is temporarily written. Therefore, when a natural image or a moving image is displayed as image data to be displayed, there is little problem in display. However, when a graphic image such as a figure or the like is displayed, degradation in image quality such as blurring of the boundary of an image, ghost, cross-talk or the like may be visually recognized. Furthermore, the driving system for selecting every two scan lines from plural scan lines under a low-temperature condition has problems that the power consumption is increased and also that the construction is more complicated. Still furthermore, according to the method of connecting RAM to an LCD controller and renewing video data to be written into the RAM concerned under a low-temperature condition at a relatively large interval, the driving timing of the liquid crystal panel by the LCD controller is fixed irrespective of the temperature, and thus this method serves as a countermeasure to erroneous display caused by the response delay of display, but has no effect on degradation of image quality of liquid crystal display such as reduction in contrast or the like.

According to an aspect of the invention, there is provided a method for driving a liquid crystal panel. The liquid crystal panel includes: a plurality of horizontal scan wires through which a gate selection signal is output; a plurality of data wires thorough which an image data signal is output; a plurality of pixel electrodes surrounded by the horizontal scan wires and the data wires; and a plurality of switching elements connected to the pixel electrodes, wherein the switching elements are controlled by the gate selection signal and during an on-time length period, the switching elements is turned on, and wherein the image data signal output from the data wires is supplied to the pixel electrodes by the switching elements. Then, the method includes: detecting a peripheral temperature of the liquid crystal panel; and controlling the gate selection signal based on the detected peripheral temperature so that when the detected peripheral temperature is within a normal temperature range, the on-time length period is set to a first gate selection period (Th), and that when the detected peripheral temperature is within a low temperature range, the on-time length period is set to a second gate selection period (Th2) longer than the first gate selection period.

In the low temperature range where the peripheral temperature of the liquid crystal panel is low, it is easy to achieve desired transmittance, and degradation of image quality such as reduction of a contrast value or the like can be improved.

DETAILED DESCRIPTION OF THE INVENTION

Embodiment 1

Figure 1:
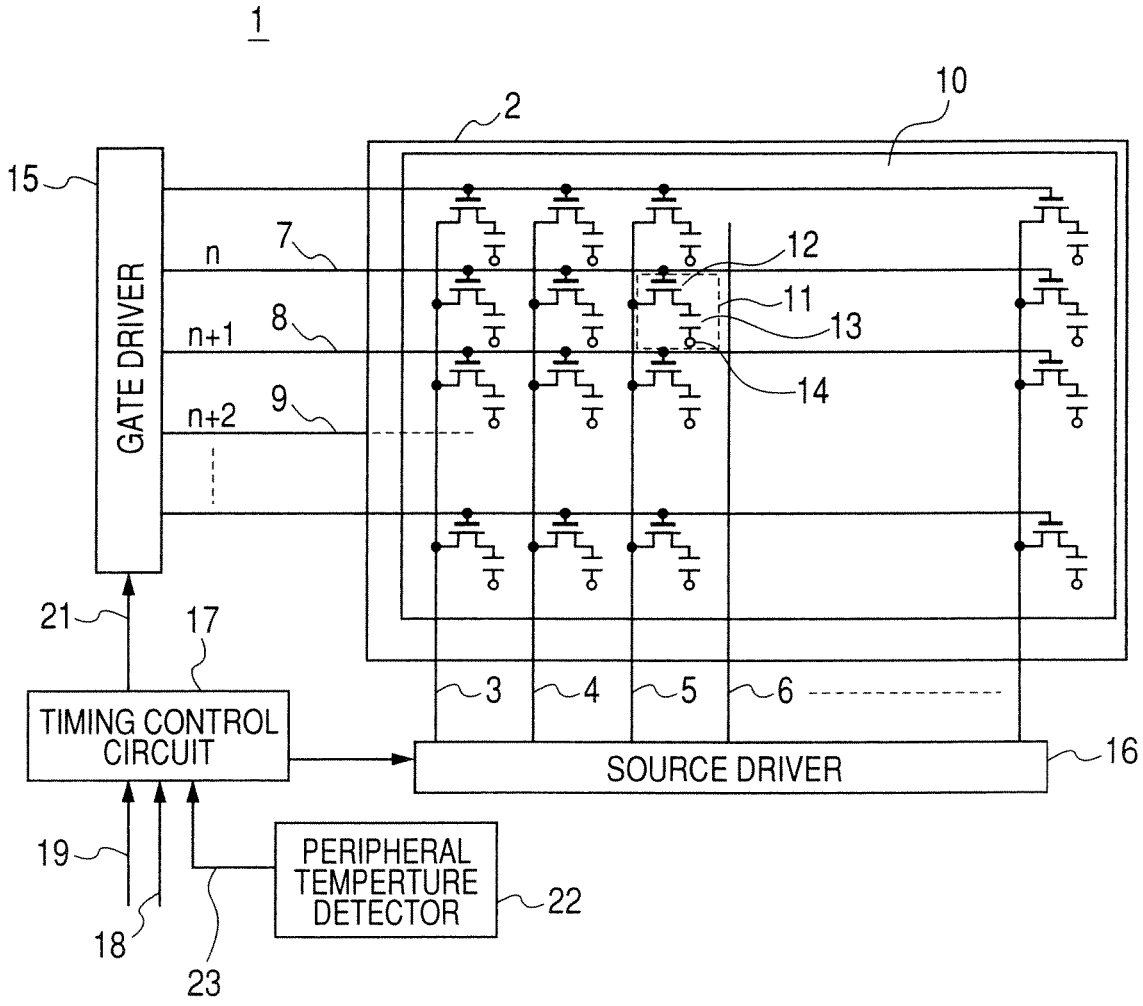
FIG. 1 is a diagram showing a system construction of a liquid crystal display device according to embodiments 1 to 3 of the invention.

FIG. 1 is a diagram showing a system construction of a liquid crystal display device 1 adopting a liquid crystal panel driving method according to Embodiment 1 of the present invention. In FIG. 1, a normally black liquid crystal panel 2 includes an active matrix substrate 20 constructed by plural data wires 3, 4, 5, 6, etc. and plural horizontal scan wires 7, 8, 9, etc. which are cross to one another and arranged in a matrix form, a counter substrate (not shown) facing the active matrix substrate 10, the active matrix substrate 10 and the counter substrate being attached to each other through a gap, and liquid crystal (not shown) is disposed in the gap so as to be sandwiched between the active matrix substrate 10 and the counter substrate. Here, in order to simplify the description, the construction of specific one pixel portion will be described in detail, and the overall liquid crystal panel 2 will be described later.

A pixel portion 11 indicated by a broken line is disposed at a cross portion between data wires 5, 6 and horizontal scan wires 7, 8. And, the pixel portion 11 has TFT 12 as a switching element and a pixel electrode 13. The horizontal scan line 7 is connected to the gate electrode of TFT 12, the data wire 5 is connected to the source electrode, and the pixel electrode 13 is connected to the drain electrode. The pixel electrode 13 forms a capacitor by sandwiching liquid crystal between the pixel electrode 13 and a counter electrode 14 serving as an electrode of the counter substrate. When a gate selection signal applied to the horizontal scan line 7 is set to "H" level, TFT 12 is turned on, and the potential of the data wire 5 at that time, that is, the image data signal is written into the pixel electrode 13. After one horizontal period elapses, the gate selection signal is set to "L" level, and TFT 12 is turned off, so that the written potential is held in the capacitor for one frame period or more. Furthermore, a gate driver 15 as a horizontal scan wire driving circuit is connected to the end portions of the horizontal scan wires 7, 8, 9, etc., and a source driver 16 as a data wire driving circuit is connected to the end portions of the data wires 3, 4, 5,6, etc. The gate drover 15 and the source driver 16 are controlled by a timing control circuit 17.

The timing control circuit 17 executes processing such as gradation correction, adjustment of timing, etc. on the basis of a video signal 18 and display control signals 19 including a display clock, a horizontal synchronous signal, a vertical synchronous signal, etc. which are input from an external display controller (not shown). And the timing control circuit 17 outputs a display control data signal 20 to the source driver 16 and outputs a horizontal scan control signal 21 to the gate driver 15.

Furthermore, a peripheral temperature detector 22 (22*a*, 22*b*) is connected to the timing control circuit 17, and the peripheral temperature detector 22 detects the peripheral temperature of the liquid crystal display panel 2 and outputs the temperature information 23 thereof to the timing control circuit 17. Furthermore, In FIG. 2A, a peripheral temperature detector 22*a* shows an example of the construction of the peripheral temperature detector 22. In this figure, 30 represents a temperature sensor and, for example, includes a thermistor whose resistance value is increased with increase of the temperature. The voltage of a reference voltage source is divided to a proper voltage by the temperature sensor 30 and the adjusting resistors 31, 32. After the range of the voltage concerned is adjusted, the divided voltage is input to an A/D (analog-digital) conversion circuit, and the temperature information 23 is output to the timing control circuit 17 as digital data correlated to the peripheral temperature. On the basis of the temperature information 23, the video signal 18 and the display control signal 19 input to the timing control circuit 17, the timing control circuit 17 outputs the horizontal scan control signal 21 and the display control data signal 20 adapted to the peripheral temperature to the gate driver 15 and the source driver 16, respectively.

Figure 3:
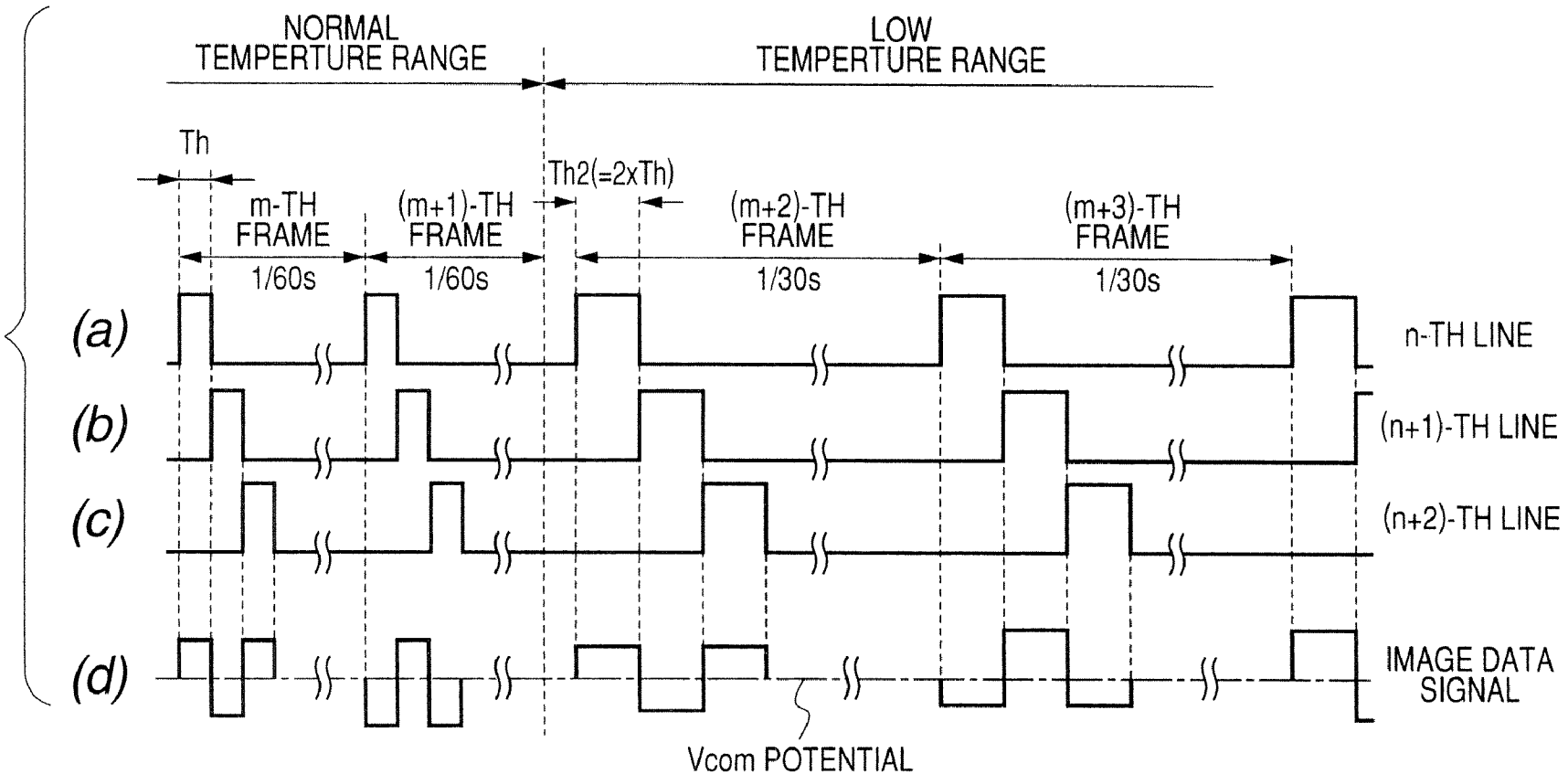
FIG. 3 is a timing chart showing waveforms of a gate selection signal and an image data signal according to the embodiment 1.

FIG. 3 is a timing chart showing the operation of the timing control circuit 17 of the embodiment 1 when the peripheral temperature of the liquid crystal display device 1 is gradually reduced, and the peripheral temperature of the liquid crystal panel 2 decreases from a normal temperature range exceeding a predetermined temperature (for example, 0° C.) to a low temperature range not more than a predetermined temperature between (m+1)-th frame and (m+2)-th frame and the temperature information 23 output from the peripheral temperature detector 22 is switched from the normal temperature range to the low temperature range. In FIG. 3, (*a*) represents the gate selection signal waveform of an n-th line 7, (*b*) represents the gate selection signal waveform of an (n+1)-th line 8, (*c*) represents the gate selection signal waveform of an (n+2)-th line, the gate selection signal waveforms being driven by the gate driver 15, and (d) of FIG. 13 represents a brief waveform of the image data signal waveform of the data wires 5 driven by the source driver 16.

First, in the normal temperature range, that is, at the m-th frame and (m+1)-th frame, the frame period representing the period of the vertical scan is identical to the vertical synchronization contained in the display control signal 19 input from the external display controller to the timing control circuit 17, and the value thereof is generally equal to 1/60s. Accordingly, the horizontal scan wires 7 (*n*-th line), 8((n+1)-th line) and 9((n+2)-th line) turn on the TFTs, and when the vertical blanking period is represented by Tvb and the total number of the horizontal scan wires of the liquid crystal panel is represented by N, the gate selection period for writing the image data signal of the data wire 5 into the pixel electrodes, that is, the first gate selection period Th is represented as follows:

$$Th=(1/60-Tvb)/N$$

In this case, as shown by the image data signal of (d) of FIG. 3, the data wire 5 is alternated by the source driver 16 so as to have a positive polarity at the m-th frame time and a negative polarity at the (m+1)-th frame time in conformity with the "H" level period of the horizontal scan wire 7 (n-th line), so that the liquid crystal layer sandwiched between the pixel electrode 13 and the counter electrode 14 is alternately driven every frame (hereinafter referred to as "one frame inversion driving"). Within the same frame, the image data signals corresponding to the "H" level period of the horizontal scan wire 7 (n-th line) and the "H" level period of the horizontal scan wire 8 ((n+1)-th line)) corresponding to the next gate selection period have the opposite polarities, so that the interference between lines is suppressed and occurrence of so-called cross-talk is prevented.

Likewise, the image data signals corresponding to the "H" level periods of the horizontal scan wire 8 ((n+1)-th line) and the horizontal scan wire 9 ((n+2)-th line) have the opposite polarities, and subsequently the polarity of the image data signal is inverted every line. As shown in the figure, a chain line drawn horizontally substantially at the center of the image data signal represents the potential Vcom of the counter electrode 14. When the corresponding TFT is turned on, the potential of the image data signal is applied to the pixel electrode, and the transmittance of the corresponding liquid crystal layer is determined by the absolute value of the potential difference between the potential Vcom of the counter electrode 14 and the potential of the pixel electrode. In the embodiment 1, the normally black liquid crystal is adopted, and thus the transmittance is increased as the absolute value is larger.

Next, there will be described a case where the peripheral temperature gradually decreases to the predetermined temperature or less between the (m+1)-th frame and the (m+2)-th frame and the temperature information 23 is equal to the value corresponding to the low temperature range as described above. In the case of the embodiment 1, when the peripheral temperature is in the low temperature range, as shown in FIG. 3, the timing control circuit 17 outputs the horizontal scan control signal 21 to the gate driver 15 so that the repetitive period of the horizontal scan wires 7 (n-th line), 8 ((n+1)-th line) and 8 ((n+2)-th line), that is, the frame period is equal to 1/30s. Likewise, the timing control circuit 17 thins out, every other frame, the video signal 18 which is transmitted generally at the frame period of 1/60s from the external display controller, whereby the writing period (writing frame period) into each pixel electrode of the liquid crystal panel 2 is set to 1/30s. Furthermore, the polarity of the potential of the data wire 5 corresponding to the "H" level period of the horizontal scan wire n-th line of (a) of FIG. 3, that is, the image data signal of (d) of FIG. 3 is inverted between the (m+2)-th frame and the (m+3)-th frame. The polarity of the image data signal of (d) of FIG. 3 which corresponds to each "H" level period is inverted every adjacent gate selection signal within the same frame.

As described above, when the vertical blanking period is represented by Tvb and the total number of the horizontal scan wires of the liquid crystal panel 2 is represented by N, the gate selection period in the low temperature range, that is, the second gate selection period Th2 is represented as follows:

$$Th2=(1/30-2Tvb)/N$$

That is, the second gate selection period is equal to 2×Th.

According to the embodiment 1, the charging time for each pixel in the low temperature range, that is, the second gate selection period Th2 is equal to 2×Th, and thus it is twice as long as the charting time under the driving condition in the normal temperature range shown in FIG. 3, that is, the first gate selection period Th. Therefore, a sufficiently long charging time can be achieved for TFT whose charging characteristic is lowered under the low temperature environment, and thus the potential of the pixel electrode approaches to a theoretical value, thereby suppressing reduction in contrast and non-uniformity of brightness in a display frame.

In the foregoing description, the driving control for the horizontal scan wires 7, 8, 9, the pixel portion 11 and the data wire 5 in the active matrix substrate 10 is mainly described in order to simplify the description. However, it is needless to say that the same driving control as described above can be executed with respect to the control of the other horizontal scan wires, pixel portions and data wires.

In the foregoing description, the description is made particularly about the frames from the m-th frame to the (M+3)-th frame, however, it is needless to say that the same operation is repeated for before and after these frames.

In the embodiment 1, with respect to the general video signal 18 of 60 Hz transmitted from the external display controller, the display control data signal 20 output to the source driver 16 is thinned out every other frame, and renewed at 30 Hz. When the video signal 18 from the external display controller has a frequency other than 60 Hz, the renewal frequency of the display control data signal 20 output to the source driver 16 is lengthened and the gate selection period is extended by the same construction, whereby the same effect can be achieved.

According to the embodiment 1, with respect to the video signal 18 transmitted from the external display controller, the display control data signal 20 output to the source driver 16 is thinned out every other frame. However, the display control data signal 20 may be generated from the video signal 18 corresponding to plural different frames input to the liquid crystal display device 1 by calculation. For example, when the frame frequency is set to 60 Hz in the normal temperature range and also the frame period is doubled to 30 Hz in the low temperature range, the video signal 18 corresponding to two frames are averaged and set as an image data signal of the data wire 5, so that the liquid crystal panel 2 can be driven without thinning out the video signal. Likewise, in the low temperature range, when the frame period is extended three times to 20 Hz, the video signal 18 corresponding to three frames may be averaged and set as an image data signal of the data wire 5.

Figure 2A:
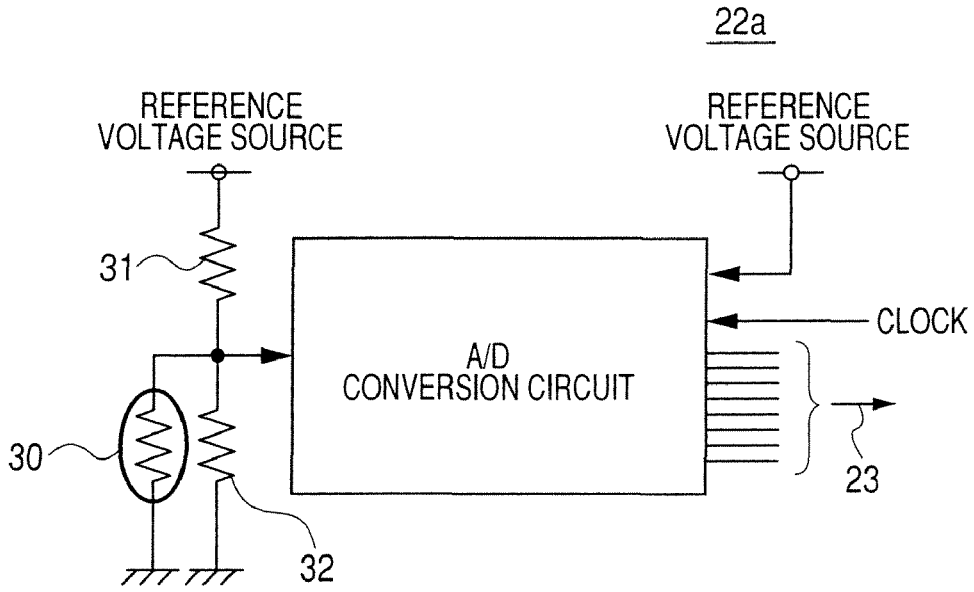
FIGS. 2A and 2B are diagrams showing examples of a construction of a peripheral temperature detector according to the embodiments 1 to 3.

With respect to the peripheral temperature detector 22*a* shown in FIG. 2A, the temperature information 23 is output as the digital data correlated to the peripheral temperature, and thus the switching temperature between the normal temperature range and the low temperature range can be relatively freely set in the timing control circuit 17. Furthermore, a so-called hysteresis characteristic can be provided by interposing some gap between the switching temperature when the peripheral temperature is increasing and the switching temperature when the peripheral temperature is decreasing, whereby the stability of display quality in the neighborhood of the predetermined temperature can be enhanced. For example, a threshold value for the switching from the normal temperature range where the frame frequency is equal to 60 Hz to the low temperature range where the frame frequency is changed to 30 Hz may be set to 0° C., and a threshold value for the switching from the low temperature range where the frame frequency is equal to 30 Hz to the normal temperature range where the frame frequency is equal to 30 Hz to the normal temperature range where the frame frequency is equal to 60 Hz may be set to 5° C. or the like.

Figure 2B:
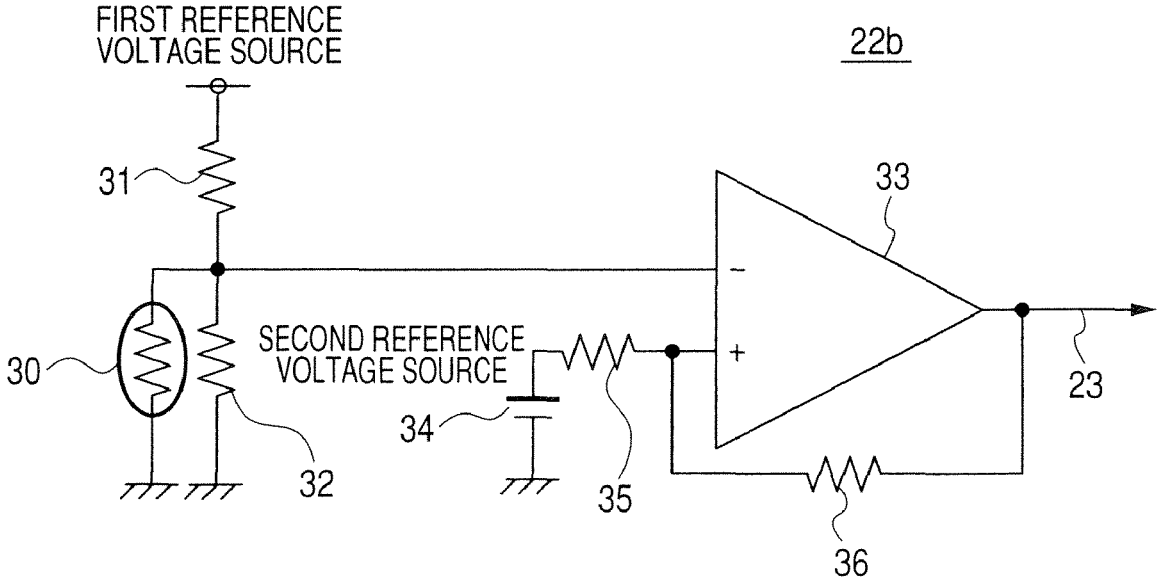

Furthermore, another construction of a peripheral temperature detector 22*b* shown in FIG. 2B will be described. 30 represents the temperature sensor, and is constructed by a thermistor whose resistance value increases in connection with temperature increase as in the case of the example shown in FIG. 2A, for example. The voltage of the first reference voltage source is divided to a proper voltage level by the temperature sensor 30 and the adjusting resistors 31, 32, and input to the negative input terminal of a comparator 33. As described above, the resistance value of the temperature sensor 30 increases/decreases in connection with the increase/decrease of the temperature, and thus the voltage of the negative input terminal of the comparator 33 also increases/decreases in connection with the increase/decrease of the peripheral temperature. A second reference voltage source 34 is connected to through a resistor 35 to the positive input terminal of the comparator 33, and the resistors 35 and 36 constitute a positive feedback circuit to achieve a hysteresis characteristic in the comparator characteristic. Therefore, when the voltage of the second reference voltage source 34 and the negative input terminal voltage of the comparator 33 have substantially the same voltage value, occurrence of noises to the output of the comparator can be suppressed by the hysteresis characteristic. As described above, when the resistance value of the temperature sensor 30 increases/decreases in connection with the increase/decrease of the peripheral temperature and thus the voltage of the negative input terminal voltage increases/decreases, the output of the comparator 33 is set to "L"/"H" level as compared with the voltage of the second reference voltage source 34. As described above, the temperature information 23 indicating whether the peripheral temperature is in the normal temperature range ("L" level) or the low temperature range ("H" level) can be transmitted to the timing control circuit 17 on the basis of the output value of the comparator 33 as described above.

Embodiment 2

First, the system construction of a liquid crystal display device adopting a method of driving a liquid crystal panel according to an embodiment 2 is the same as the construction shown in FIG. 1 in the embodiment 1, and thus the detailed description is omitted. In the following description, the operation of the timing control circuit 17 in the low temperature range will be described with reference to the timing chart of FIG. 4.

Here, when the peripheral temperature exceeds a predetermined temperature (for example, 0° C.) and thus the temperature information 23 output from the peripheral temperature detector 22 indicates a value of the normal temperature range, the timing control circuit 17 executes the same control as the operation in the normal temperature range described in the above-described embodiment 1, that is, carries out the one-frame inversion driving operation in which the polarity of the image data signal applied to the data wire 5 is inverted every frame, and thus the detailed description thereof is omitted from the following description.

Figure 4:
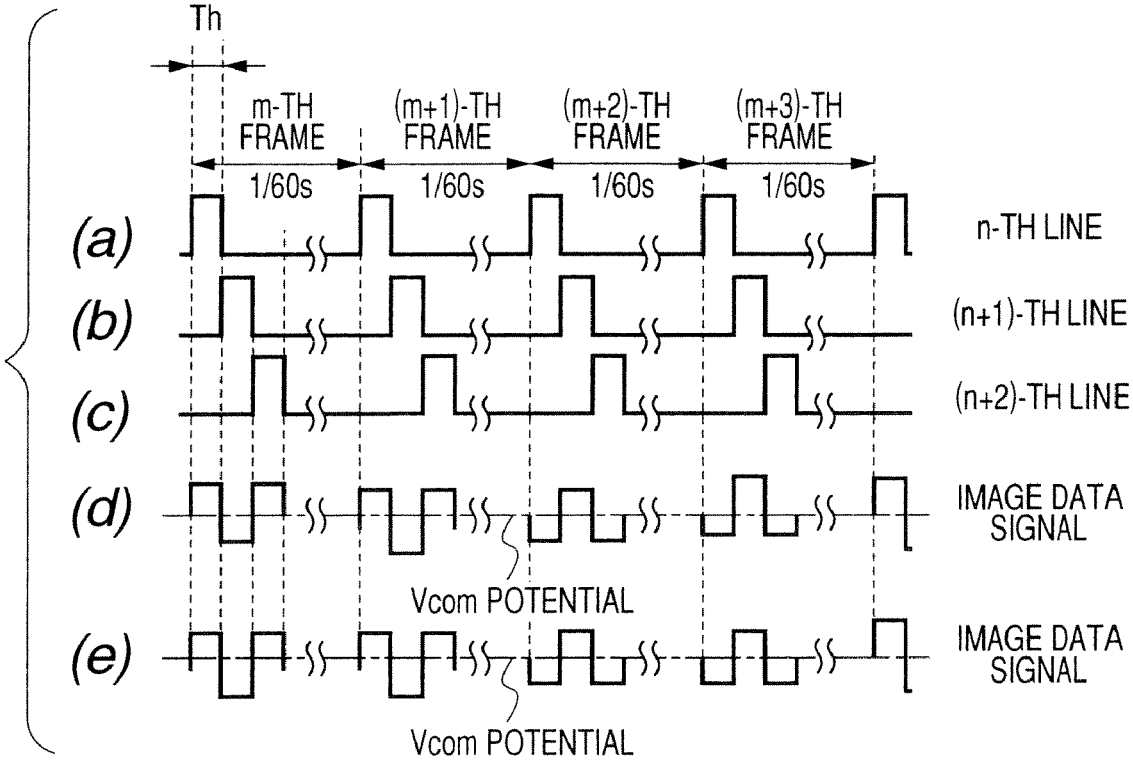
FIG. 4 is a timing chart showing waveforms of a gate selection signal and an image data signal according to the embodiments 2 and 3.

Next, the waveforms of the gate selection signal and the image data signal in the low temperature range (for example, below 0° C.) in the embodiment 2 of the present invention will be schematically described with reference to FIG. 4. In FIGS. 4, (*a*), (*b*) and (*c*) show the gate selection signals of the adjacent horizontal scan wires 7(*n*-th line), 8((n+1)-th line) and 9 ((n+2)-th line) of FIG. 1, and also show the behavior of the waveform among the sequential frames like an m-th frame, an (m+1)-th frame, an (m+2)-th frame and an (m+3)-th frame. (d) of FIG. 4 shows the behavior of the image data signal of the data wire 5 of FIG. 1.

The pulse height value of the image data signal shown in (d) of FIG. 4 from the counter electrode potential Vcom is renewed every frame. The polarity of the pulse height value is inverted every two frames so that the m-th frame and the (m+1)-th frame have a first polarity, the polarity is inverted between the (m+1)-th frame and the (m+2)-th frame and the (m+2)-th frame and the (m+3)-th frame have a second polarity (hereinafter referred to as "two-frame inversion driving). The gate selection signal and the image data signal are output from the gate driver 15 and the source driver 16 on the basis of the horizontal scan control signal 21 and the display control data signal 20 output from the timing control circuit 17 as in the case of the embodiment 1.

As in the case of the embodiment 1, the image data signal shown in (d) of FIG. 4 which correspond to the "H" level periods of the horizontal scan wires 7(*n*-th line) and 8 ((n+1)-th line) respectively have the opposite polarities within the same frame as shown in (a), (b) of FIG. 4, and the driving polarity of the image data signal is subsequently inverted every line. As shown in FIG. 4, a chain line drawn horizontally substantially at the center of the image data signal as shown in FIG. 4 represents the potential Vcom of the counter electrode 14. The potential of the image data signal is written into the pixel electrode 13 when TFT connected to the data wire 5 is turned on, the voltage between the pixel electrode 13 and the counter electrode 14 is applied to the liquid crystal layer, and the transmittance of the liquid crystal layer corresponding to the pixel electrode 13 is determined by the absolute value of this voltage. In the embodiment 2, the normally black liquid crystal is used, and thus the transmittance is increased as the absolute value is larger.

The behavior of the potential of the pixel electrode under the two-frame inversion driving operation and the corresponding transition of the transmittance of the liquid crystal will be described in detail with reference to FIG. 5 by exemplifying the pixel portion 11 driven by the horizontal scan wire 7(*n*-th line) and the data wire 5 in FIG. 1.

Figure 5:
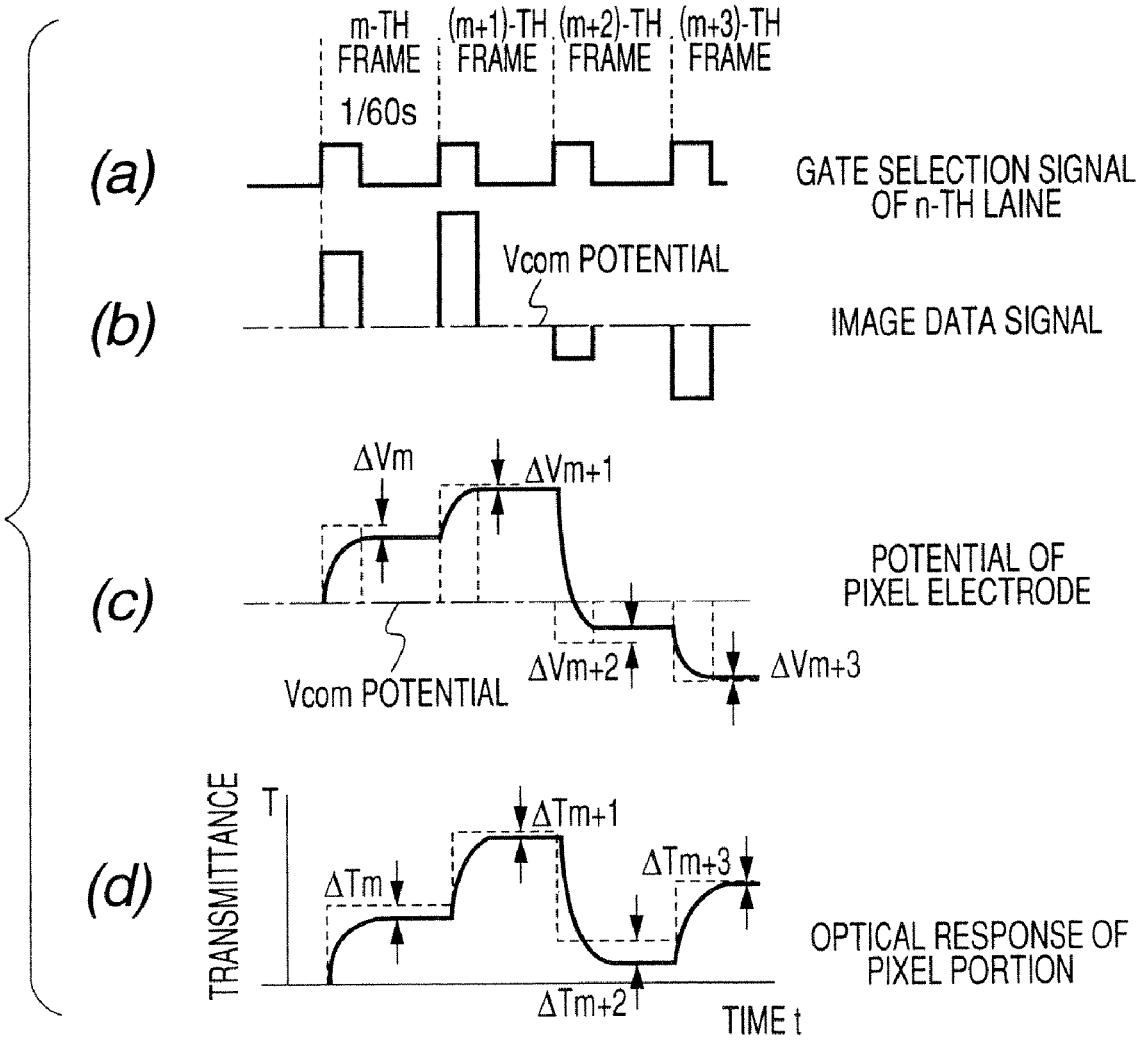
FIG. 5 is a diagram showing a pixel electrode potential and a transition of transmittance according to the embodiment 2.

In FIG. 5, (*a*) shows a repetitive gate selection signal waveform over the range from the m-th frame to the (m+3)-th frame with respect to the horizontal scan wire 7(*n*-th line) of FIG. 1. All TFTs connected to the horizontal scan wire 7 (*n*-th line) are turned on for the period when the voltage is set to "H" level (corresponding to the Th period of FIG. 4), and the horizontal scan is carried out. Here, the frame period is fixed to 1/60s over all the frames containing the frames from the m-th frame to the (m+3)-th frame. In FIG. 5, (*b*) shows a waveform of the image data signal applied to the data wire 5 in which only the potential corresponding to the period when the horizontal scan wire 7(*n*-th line) is set to "H" level is extracted. In this embodiment 2, the two-frame inversion driving operation is adopted in the low temperature range, and the polarity is inverted between the (m+1)-th frame and the (m+2)-th frame as indicated by a solid line of (b) of FIG. 5.

All the TFTs connected to the horizontal scan wire 7 are turned on all at once by the horizontal scan of the horizontal scan wire 7(*n*-th line), so that the potential indicated by the image data signal of the data wire 5 is successively written into the pixel electrode 13 connected to TFT 12 over the frame range from the m-th frame to the (m+3)-th frame. As a result, the potential of the pixel electrode becomes a waveform indicated by a solid line of (c) of FIG. 5. Here, with respect to the retention potentials of the pixel electrode 13 in the (m+1) frame and the (m+3)-th frame, when the potential differences thereof from the ideal retention potential indicated by a dashed line of (c) of FIG. 5 are represented by ΔVm+1 and ΔVm+3, the pixel electrode 13 can be sufficiently charged because the polarity is not inverted between both the frames, and thus the potential differences are minimum as shown in FIG. 5.

Furthermore, the waveform indicated by a solid line of (d) of FIG. 5 shows the optical response of the pixel portion 11 corresponding to the pixel electrode 13 having the retention potential shown in (c) of FIG. 5. With respect to the value of the transmittance T at the (m+1)-th frame and the (m+3)-th frame in (d) of FIG. 5, the differences ΔTm+1 and ΔTm+3 from the ideal response waveform indicated by a dashed line are slight, and thus desired transmittance T can be achieved in the low temperature range.

As described above, by adopting the two-frame inversion driving, not only desired transmittance can be easily achieved in the (m+1)-th frame and the (m+3)-th frame even when the peripheral temperature is in the low temperature range, and the reduction of the contrast value can be improved, but also degradation of the image quality of moving pictures such as after-image, ghost, etc. under a low-temperature condition can be improved. In this case, the description is made particularly on the frame range from the m-th frame to the (m+3)-th frame, however, it is needless to say that the same operation is repetitively carried out on frames before and after the above frames.

Furthermore, in order to simplify the description, the driving control on the horizontal scan wires 7, 8, 9, the pixel portion 11 and the data wire 5 in the active matrix substrate is particularly described. However, it is needless to say that the same driving control is carried out on the other horizontal scan wires, pixel portions and data wires.

Embodiment 3

First, the system construction of a liquid crystal display device using a method for driving a liquid crystal panel according to an embodiment 3 is the same as the construction of FIG. 1 in the embodiment 1, and thus the detailed description is omitted from the following description. The operation of the timing control circuit 17 in the low temperature range will be described hereunder with reference to the timing chart of FIG. 4.

When the peripheral temperature exceeds a predetermined temperature (for example, 0° C.) and the temperature information 23 output from the peripheral temperature detector 22 indicates the value of the normal temperature range, the timing control circuit 17 executes the same control as the operation in the normal temperature range described in the embodiment 1, that is, the timing control circuit 17 executes the one-frame inversion driving operation in which the polarity of the image data signal applied to the data wire 5 is inverted every frame, and the detailed description thereof is omitted from the following description.

Next, the waveforms of the gate selection signal and the image data signal in the low temperature range (for example, below 0° C.) according to the embodiment 3 of the present invention will be schematically described with reference to FIG. 4. In FIGS. 4, (*a*), (*b*) and (*c*) show the gate selection signals of the adjacent horizontal scan wires 7(*n*-th line), 8((n+1)-th line) and 9((n+2)-th line) in FIG. 1, and also show the behaviors of the waveforms between sequential frames such as the m-th frame, (m+1)-th frame, (m+2)-th frame and (m+3)-th frame. Furthermore, (e) of FIG. 4 shows the behavior of the image data signal of the data wire 5 in FIG. 1.

The image data signal shown in (e) of FIG. 4 is subjected to the two-frame inversion driving operation in which the polarity thereof is inverted every two frames, and the m-th frame and the (m+1)-th frame have the first polarity while the (m+2)-th frame and the (m+3)-th frame have the second polarity. Furthermore, the video signal 18 is thinned out every other frame so that the pulse height value of the image data signal from the potential Vcom of the counter electrode has the first pulse height value corresponding to the same pulse height value at the m-th frame and the (m+1)-th frame and the second pulse height value corresponding to the same pulse height value at the (m+2)-th frame and the (m+3)-th frame, and the pulse height value is renewed at 30 Hz. The gate selection signals and the image data signals described above are controlled by the horizontal scan control signal 21 and the display control data signal 20 output from the timing control circuit 17 and output from the gate driver 15 and the source driver 16 as in the case of the embodiment 1.

Figure 6:
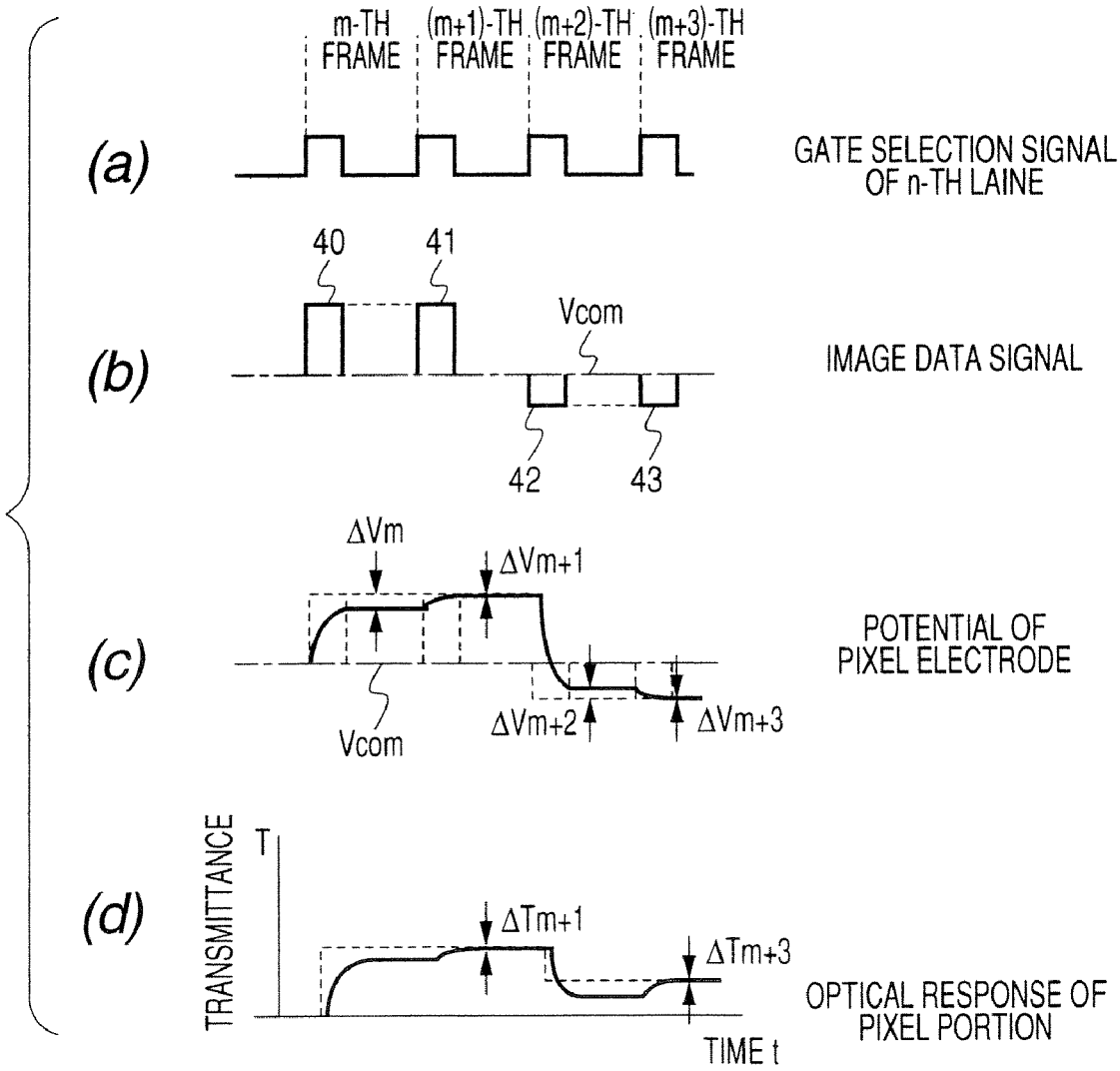
FIG. 6 is a diagram showing the pixel electrode potential and the transition of the transmittance according to the embodiment 3.

Next, the optical response of the data wire 5 and the pixel portion 11 will be described in detail with reference to FIG. 6. In FIG. 6, (*a*) shows a repetitive gate selection waveform over the frame range from the m-th frame to the (m+3)-th frame of the horizontal scan wire 7 (*n*-th line). All TFTs connected to the horizontal scan wire 7(*n*-th line) is turned on for the period when the voltage is set to "H" level (corresponding to the Th period of FIG. 4), and the horizontal scan is carried out. Here, the frame period is fixed to 1/60s from the m-th frame to the (m+3)-th frame. With respect to the image data signal applied to the data wire 5, (*b*) of FIG. 6 shows a waveform of the image data signal applied to the data wire 5 in which only the potential corresponding to the period when the horizontal scan wire 7(*n*-th line) is set to "H" level is extracted. According to the embodiment 3, in the low temperature range, the two-frame inversion driving operation is adopted, and the image data signal is inverted in polarity at the frame switching time point from the (m+1)-th frame to the (m+2)-th frame. Furthermore, as described above, the video signal 18 is thinned out every other frame so that the levels 40, 41 having the same pulse height value are set at the m-th frame and (m+1)-th frame and the levels 42, 43 having the same pulse height value are set at the (m+2)-th frame and the (m+3)-th frame.

As described above, when the gate selection signal shown in (a) of FIG. 6 is applied the horizontal scan wire 7 (*n*-th line) and the image data signal shown in (b) of FIG. 6 is applied to the data wire 5, the potential of the pixel electrode 13 becomes a waveform indicated by a solid line in (c) of FIG. 6. Here, with respect to the retention potentials of the pixel electrode 13 at the (m+1)-th frame and (m+3)-th frame, when the potential differences from the ideal retention potential indicated by a dashed line of (c) of FIG. 6 are represented by ΔVm+1 and ΔVm+3, the polarity is not inverted between both the frames, and the same potential as the just preceding frame is written at each of the frames, so that the charging into the pixel electrode 13 can be surely performed, and the potential difference is minimum as shown in FIG. 6.

The waveform indicated by a solid line of (d) of FIG. 6 shows a response waveform of the transmittance T of the pixel portion 11 corresponding to the pixel electrode 13 having the retention potential shown in (c) of FIG. 6. In (d) of FIG. 6, with respect to the value of the transmittance T at the (m+1)-th frame and the (m+3)-th frame, the differences ΔTm+1 and ΔTm+3 from the ideal response waveform indicated by a dashed line are slight, and thus desired transmittance T can be achieved in the low temperature range.

In order to simplify the description, the driving control on the horizontal scan wires 7, 8, 9, the pixel portion 11 and the data wire 5 in the active matrix substrate 10 is particularly described, however, it is needless to say that the same driving control is carried out on the other horizontal scan wires, pixel portions and data wires.

As described above, the two-frame inversion driving operation is adopted in the low temperature range, and further the same pulse height value is applied between the two frames having the same polarity. Therefore, not only desired transmittance can be easily achieved at the (m+1)-th frame and the (m+3)-th frame, and the reduction of the contrast value can be improved, but also degradation of the image quality of moving pictures such as after-image, ghost, etc. under the low temperature condition can be also improved. The foregoing description is made particularly on the frames from the m-th frame to the (m+3)-th frame, however, it is needless to say that the same operation is repetitively carried out on the frames before and after the frames concerned.

In the embodiment 3, the display control data signal 20 output to the source driver 16 is thinned every other frame with respect to the video signal 18 transmitted from the external display controller, and the display control data signal 20 is renewed at 30 Hz. However, the display control data signal 20 may be generated by calculation using the video signal 18 corresponding to plural different frames of the video signal 18 input to the liquid crystal display device 1. For example, when the display control data signal 20 is renewed at 60 Hz in the normal temperature range and the display control data signal 20 is renewed at 30 Hz in the low temperature range, if the video signal 18 corresponding to two frames is averaged and set as an image data signal, the liquid crystal panel 2 can be driven without thinning out the video signal. Likewise, when the display control data signal 20 is renewed at 20 Hz in the low temperature range, the video signal 18 corresponding to three frames may be averaged and set as an image data signal of the data wire 5.

In the above-described embodiments 1, 2, 3, in order to simplify the description, the normally black mode is adopted as an example of the liquid crystal panel 2. However, a liquid crystal panel adopting a broadly popular normally white mode may be used, and it may be adopted for the invention described in the embodiments 1, 2, 3.

In the above-described embodiments 1, 2, 3, with respect to the peripheral temperature, 0° C. is used as a representative value of the boundary temperature between the normal temperature range and the low temperature range. It is unnecessary to adopt 0° C. When the reduction of the contrast and the degree of insufficient uniformity of brightness which are caused by insufficient pixel charging which is more remarkable as the peripheral temperature decreases are varied in accordance with the liquid crystal material of the liquid crystal panel, the cell gap, etc. Various kinds of images may be displayed to determine a permissible temperature through visual test.

Furthermore, the above-described embodiments 1, 2, 3 use the liquid crystal display device adopting, as an example of the liquid crystal mode, a TN liquid crystal mode or a VA liquid crystal mode in which the counter electrode is provided to the counter substrate, the liquid crystal is sandwiched between the counter substrate and the active matrix substrate, the transmittance of the liquid crystal layer is controlled by the intensity of the voltage between both the substrates. However, the liquid crystal panel driving method described in the embodiments 1, 2, 3 may be applied to a liquid crystal display device adopting a so-called IPS liquid crystal mode in which the counter electrode is formed in the active matrix substrate, and the electric field between the pixel electrode and the counter electrode is formed in the horizontal direction.

The entire disclosure of Japanese Patent Application No. 2005-201659 filed on Jul. 11, 2005 including specification, claims, drawings and abstract is incorporated herein be reference in its entirety.

What is claimed is:

1. A method for driving a liquid crystal panel, the liquid crystal panel including a plurality of horizontal scan wires through which a gate selection signal is output, a plurality of data wires thorough which an image data signal is output, a plurality of pixel electrodes surrounded by the horizontal scan wires and the data wires, and a plurality of switching elements connected to the pixel electrodes, wherein the switching elements are controlled by the gate selection signal and during an on-time length period, the switching elements is turned on, and wherein the image data signal output from the data wires is supplied to the pixel electrodes by the switching elements, the method comprising:

detecting a peripheral temperature of the liquid crystal panel; and controlling the gate selection signal based on the detected peripheral temperature so that when the detected peripheral temperature is within a normal temperature range, a first on-time length period is set to a first gate selection period, and that when the detected peripheral temperature is within a low temperature range, a second on-time length period is set to a second gate selection period longer than the first gate selection period.

2. The method according to claim 1, wherein the second on-time length period is twice as long as the first on-time length period.

3. The method according to claim 1, wherein the second on-time length period is at least twice as long as the first on-time length period.

4. A method for driving a liquid crystal panel, the liquid crystal panel including a plurality of horizontal scan wires through which a gate selection signal is output, a plurality of data wires thorough which an image data signal is output, a plurality of pixel electrodes surrounded by the horizontal scan wires and the data wires, and a plurality of switching elements connected to the pixel electrodes, wherein the switching elements are controlled by the gate selection signal, wherein the image data signal output from the data wires is supplied to the pixel electrodes by the switching elements, the method comprising:

detecting a peripheral temperature of the liquid crystal panel; and controlling the data signal based on the detected peripheral temperature so that when the detected peripheral temperature is within a normal temperature range, a polarity of the data signal is inverted for each frame, and that when the detected peripheral temperature is within a low temperature range, the polarity of the data signal is inverted for every other frame.

5. The method according to claim 4, wherein when the detected peripheral temperature is within the low temperature range, a same image data signal as a preceding frame is supplied to the data wires for a frame in which the polarity is not inverted.

6. The method according to claim 2, wherein when the detected peripheral temperature is within the low temperature range, the image data signal is generated by calculating video data corresponding to a plurality of frames, and the image data signal is supplied to the data wires.

7. A liquid crystal display device comprising:

a liquid crystal panel including, a plurality of horizontal scan wires through which a gate selection signal is output, a plurality of data wires thorough which an image data signal is output, a plurality of pixel electrodes surrounded by the horizontal scan wires and the data wires, and a plurality of switching elements connected to the pixel electrodes, wherein the switching elements are controlled by the gate selection signal and during an on-time length period, the switching elements is turned on, and wherein the image data signal output from the data wires is supplied to the pixel electrodes by the switching elements;

a horizontal scan wire driving circuit that supplies the gate selection signal to the horizontal scan wires;

a data wire driving circuit that supplies the image data signal to the data wires;

a temperature detector that detects the peripheral temperature of the liquid crystal panel; and a timing control circuit that is connected to the horizontal scan wire driving circuit, the data wire driving circuit and the temperature detector, wherein the timing control circuit drives the liquid crystal panel by controlling gate selection signals based on the detected peripheral temperature so that when the detected peripheral temperature is within a normal temperature range, a first on-time length period is set to a first gate selection period, and that when the detected peripheral temperature is within a low temperature range, a second on-time length period is set to a second gate selection period longer than the first gate selection period.

* * * * *